United States Patent [19]

Dill

[11] Patent Number: 4,695,718

[45] Date of Patent: Sep. 22, 1987

[54] PROTECTIVE LIGHT FILTER SYSTEM FOR IMAGE INTENSIFIER

[75] Inventor: James M. Dill, Pompano Beach, Fla.

[73] Assignee: EOL$_3$ Company, Inc., Fort Lauderdale, Fla.

[21] Appl. No.: 883,636

[22] Filed: Jul. 9, 1986

[51] Int. Cl.[4] ..... H01J 31/50

[52] U.S. Cl. ..... 250/213 VT; 250/551

[58] Field of Search ..... 250/213 VT, 213 R, 551; 313/532, 533, 534, 535, 536

[56] References Cited

U.S. PATENT DOCUMENTS 3,449,619 6/1969 Stalp ..... 250/551
3,595,146 7/1971 Johnson ..... 250/213 VT
3,631,252 12/1971 Gebel ..... 250/213 VT
4,433,236 2/1984 Shimada ..... 250/213 VT
4,558,226 12/1985 Takada et al. ..... 250/551

FOREIGN PATENT DOCUMENTS 0049076 4/1977 Japan ..... 250/213 VT

*Primary Examiner*—David C. Nelms
*Assistant Examiner*—Chang K. Seo
*Attorney, Agent, or Firm*—Oltman and Flynn

[57] ABSTRACT

The photocathode of an image intensifier is protected from undue exposure to excessive incident light by a variable density filter whose density is controlled by an optical coupler. The optical coupler has an LED which conducts power supply current to the image intensifier and a phototransistor in the energization circuit of a filter driver which operates the variable density filter.

6 Claims, 3 Drawing Figures

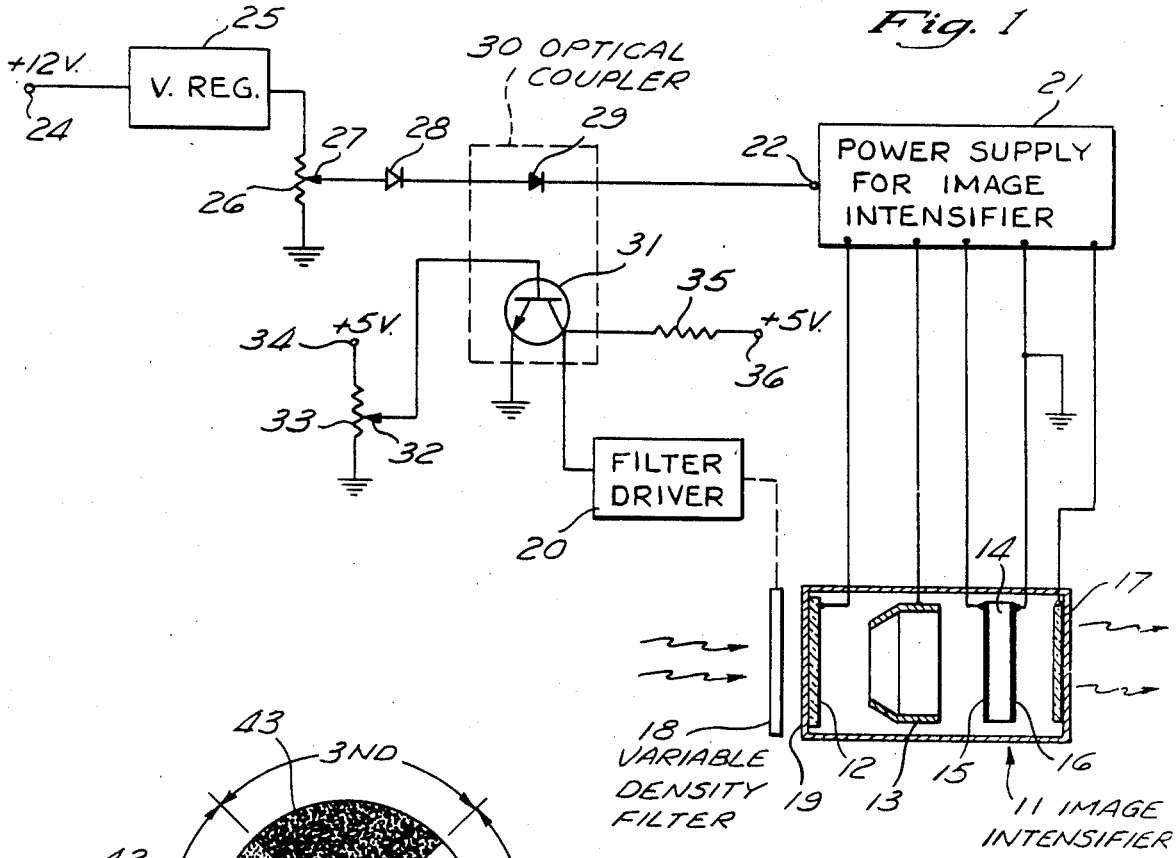
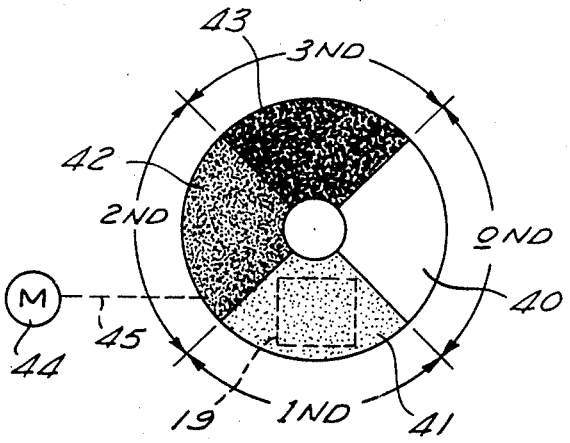
Fig. 2
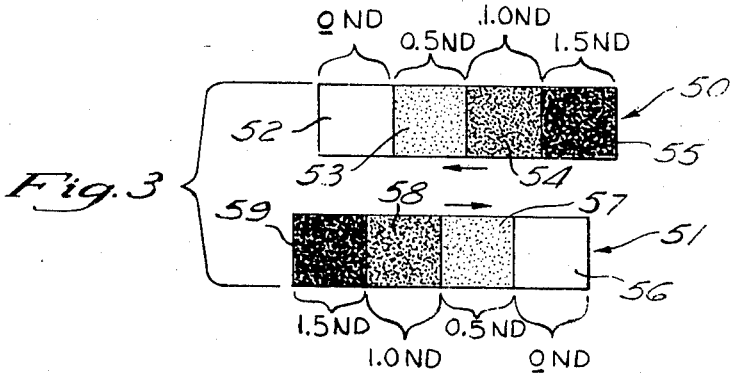
Fig. 3

PROTECTIVE LIGHT FILTER SYSTEM FOR IMAGE INTENSIFIER

SUMMARY OF THE INVENTION

This invention relates to an arrangement for protecting the photocathode of an image intensifier from damaging exposure to excessively high incident light.

Image intensifiers, particularly those of the "second generation" type having microchannel plates, have a life which is inversely proportional to the time the photocathode is saturated by incident light. A safe light level input for the photocathode is about 0.1 foot candle. Noon sunlight develops a light level of about 10,000 foot candles on the photocathode of such an image intensifier. To protect the photocathode from prolonged exposure to excessively high incident light, it has been proposed to provide in the path of the light input to the photocathode a lens and a spot filter which masks the center of the lens, but this degrades the image. Another proposal has been to use a separate light sensor controlling a neutral density filter in the path of the light input to the photocathode, but this is not entirely satisfactory because the separate light sensor does not sense the same light as is impinging on the photocathode.

The present invention is based on a recognition that the power supply current of the image intensifier is a function of the input light to its photocathode. A variable density filter in the path of the input light to the photocathode reduces that input light in proportion to increases in the power supply current so as to prevent saturation of the photocathode for an excessive period of time. The variable density filter is controlled by a filter driver energized by the output of an optical coupler having a light emitting device energized by the power supply surrent and a light sensing device connected to the filter driver. Power supply current changes in the light emitting device produce greatly amplified current changes in the light sensing device of the optical coupler for controlling the density of the filter. Preferably, the light emitting device is a light emitting diode with a substantially constant voltage drop at different currents and the light sensing device is a phototransistor.

A principal object of this invention is to provide a novel protective arrangement for the photocathode of an image intensifier to prevent damaging exposure to excessive incident light.

Further objects and advantages of this invention will be apparent from the following detailed description of presently preferred embodiments which are illustrated schematically in the accompanying drawings.

DESCRIPTION OF THE DRAWINGS

FIG. 1 shows the present invention schematically;

FIG. 2 shows a variable density filter in the form of a disc with successive sectors of different densities, the disc being indexed to different relative positions;

FIG. 3 shows a different type of variable density filter.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIG. 1, reference numeral 11 designates generally an image intensifier tube of known design which is shown in simplified schematic form here. It has a photocathode 12 at one end which is exposed to incident light, an anode and focusing cone 13, a microchannel plate 14 having an input electrode 15 on its face toward the photocathode and an output electrode 16 on its face away from the photocathode, and a phosphorescent output screen 17 at the opposite end. This is a typical "second generation" image intensifier. The optical image formed on the photocathode 12 by the incident light is converted by it into an electron image, which is multipled by the microchannel plate 14 and applied to the output screen 17, which produces an optical image which is an intensified replica of the optical image on the photocathode.

In one practical embodiment, the photocathode 12 is at −1750 volts, the anode and focusing cone 13 is at +1000 volts, the input electrode 15 of the microchannel plate 14 is at +900 volts and its output electrode 16 is at reference ground, and the output screen 17 is at +6000 volts. In portable image intensifier these voltages are supplied by an internal power supply having a three volt DC power source in the form of two size AA dry cell batteries. This battery voltage is stepped up in the internal power supply to provide the different voltages for the various electrodes of the image intensifier.

In accordance with the present invention, a variable density optical filter 18 is located immediately in front of the transparent end wall 19 of the image intensifier tube just ahead of the photocathode 12. The variable density filter 18 preferably is of known design, such as either of the two different embodiments shown in FIGS. 2 and 3.

In FIG. 2 the filter 18 is a thin circular disc comprised of four sectors extending in succession circumferentially 90 degrees each. These are a zero neutral density filter sector 40, a 1.0 neutral density sector 41, a 1.5 neutral density sector 42, and a 3.0 neutral density sector 43. The filter disc is rotatively indexed by a filter driver in the form of a D.C. stepping motor 44 through any suitable drive arrangement, shown schematically by the dashed line 45. FIG. 2 shows the filter disc in the rotative or angular position in which its 1.0 neutral density sector 41 covers the end wall 19 of the image intensifer tube, in the path of incident light to the photocathode 12 of the image intensifier. The filter disc may be rotated to put its 1.5 neutral density sector 42 or its 3.0 neutral density sector 43 or its zero neutral density sector 40 in front of the end wall 19 of the image intensifer.

In FIG. 3 the variable density filter has two flat filter panels 50 and 51, one directly behind the other, which are shifted laterally in opposite directions to provide various total densities. Filter panel 50 presents in succession, from left to right, a zero neutral density filter 52, a 0.5 neutral density filter 53, a 1.0 neutral density filter 54, and a 1.5 neutral density filter 55. Filter panel 51 presents in succession from right to left a zero neutral density filter 56, a 0.5 neutral density filter 57, a 1.0 neutral density filter 58, and a 1.5 neutral density filter 59.

The panels are driven in any suitable fashion from a filter driver in the form of a stepping motor such that the following different registrations take place in different positions of the filter panels:

(1) the zero neutral density filters 52 and 56 register with each other directly in front of the transparent end wall 19 of the image intensifier tube 11, providing a total filter density of zero;

(2) the 0.5 neutral density filters 53 and 57 register with each other in front of end wall 19, providing a total filter density of 1.0;

(3) the 1.0 neutral density filters 54 and 58 register with each other in front of end wall 19, providing a total filter density of 2.0;

(4) the 1.5 neutral density filters 55 and 59 register with each other in front of end wall 19, providing a total filter density of 3.0.

Thus, this filter assembly can provide selectively no light filtering or any one of three different filter densities.

Referring to FIG. 1, the variable density filter is shown schematically at 18 and the filter driver, comprising the stepping motor and the drive which couples it mechanically to the variable density filter, is shown schematically at 20. The conventional internal power supply for the image intensifier is shown schematically at 21. This power supply has a three volt battery not shown.

In accordance with the present invention, the power supply 21 for the image intensifier has an input terminal 22 which is energized by a 12 volt battery having a positive terminal 24 connected to the input of a voltage regulator 25. The output of the voltage regulator is connected across a resistance 26 having an adjustable potentiometer tap 27, which is connected through a rectifier diode 28 and a light emitting diode 29 to the input terminal 22 of the power supply 21 for image intensifier 11. The voltage drop across diode 28 is about 0.7 volts. The voltage drop across LED 29 is a constant value within the range from about 1.2 to 2.0 volts, depending upon the model of the LED. Potentiometer tap 27 is adjusted to provide +3 volts at the input terminal 22 of the power supply for the image intensifier when there is no light input to the photocathode 12 of the image intensifier 11.

The LED 29 is one element of an optical coupler enclosed by the dashed-line box 30 in FIG. 1. The other element of this optical coupler is a grounded-emitter phototransistor 31 having its base electrode exposed to LED 29 to receive light emitted by the LED. The base of the phototransistor is connected to an adjustable tap 32 on a potentiometer 33 whose upper end is connected to a +5 volt power supply terminal 34 and whose lower end is grounded. The collector of phototransistor 35 is connected through a resistor 35 to a +5 volt power supply terminal 36. The collector also is connected to the input terminal of the stepping motor in the filter driver 20.

Power supply current drawn by the image intensifier tube 11 from the 12 volt battery flows through LED 29 in the optical coupler 30. This LED has a constant voltage drop over a wide range of current variations. The light output from LED 29 varies with its current, which increases with an increase in the incident light impinging on the photocathode 12 of the image intensifier. The current through phototransistor 31 changes as a function of the changes in the light output from LED 29 and this current, which drives the stepping motor in filter driver 20, controls the variable density filter 18 so as to increase the filter density as the current drawn by the image intensifier tube 11 increases. The net result is that the variable density filter 18 prevents excessive light from impinging on the photocathode 12 of the image intensifier and thus drastically shortening its operating life.

In the present invention the phototransistor 31 acts as a current amplifier, greatly amplifying the current changes in LED 29. The optical coupler 30 provides isolation between the power supply circuit for the image intensifier and the control circuit for the variable density filter 18.

I claim:

1. In combination with an image intensifier having a photocathode for receiving incident light and a power supply for said image intensifer, a variable density light filter controlling the level of the incident light received by said photocathode;

a current-amplifying optical coupler having a current-conducting light emitting device operatively connected in said power supply to emit light which changes in accordance with changes in the power supply current, and a light sensing current-producing device optically coupled to said light emitting device to produce current which changes in accordance with changes in the light output from said light emitting device;

and a filter driver operatively connected between said light sensing device and said filter to operate said filter to control the incident light input to said photocathode in inverse relation to the current produced by said light sensing device.

2. The combination of claim 1 wherein said light-emitting device has a substantially constant voltage drop.

3. the combination of claim 2 wherein:

said light-emitting device is a light emitting diode;

and said light-sensing device is a phototransistor.

4. A protective arrangement for the photocathode of an image intensifier having a power supply, said protective arrangement comprising:

a variable density light filter adapted to be positioned in the path of incident light to the photocathode;

a filter driver operatively connected to said filter to control the level of the incident light received by the photocathode through said filter;

and a current amplifying optical coupler comprising a current-conducting light-emitting device, means for connecting said light emitting device in the power supply for the image intensifier, said light-emitting device being operative to emit light which varies in intensity in accordance with changes in the power supply current, and a light-sensing current-producing device optically coupled to said light-emitting device to be energized by light from the latter to produce current changes which amplify the curent changes in said light-emitting device.

5. A protective arrangement according to claim 4, wherein said light-emitting device is a light emitting diode with a substantially constant voltage drop at different currents.

6. A protective arrangement according to claim 5, wherein said light-sensing device is a phototransistor.

* * * * *